US010493311B2

(12) United States Patent
Chou

(10) Patent No.: US 10,493,311 B2
(45) Date of Patent: Dec. 3, 2019

(54) ADJUSTABLE AIR BIKE FAN BLADES

(71) Applicant: Cheng I Chou, City of Industry, CA (US)

(72) Inventor: Cheng I Chou, City of Industry, CA (US)

(73) Assignee: Paradigm Health and Wellness, Corona, CA (US)

( * ) Notice: Subject to any disclaimer, the term of this patent is extended or adjusted under 35 U.S.C. 154(b) by 133 days.

(21) Appl. No.: 15/466,787

(22) Filed: Mar. 22, 2017

(65) Prior Publication Data

US 2017/0274238 A1 Sep. 28, 2017

Related U.S. Application Data

(60) Provisional application No. 62/312,395, filed on Mar. 23, 2016.

(51) Int. Cl.

| | |
|---|---|
| ***A63B 21/008*** | (2006.01) |
| ***A63B 22/06*** | (2006.01) |
| ***A63B 22/02*** | (2006.01) |
| *A63B 22/04* | (2006.01) |

(52) U.S. Cl.

CPC ..... *A63B 21/0088* (2013.01); *A63B 22/0605* (2013.01); *A63B 22/02* (2013.01); *A63B 22/04* (2013.01); *A63B 22/0664* (2013.01)

(58) Field of Classification Search

CPC . A63B 21/0088; A63B 22/04; A63B 22/0664; A63B 22/02; A63B 22/0605

See application file for complete search history.

(56) References Cited

U.S. PATENT DOCUMENTS

| | | | | |
|---|---|---|---|---|
| 2,178,405 | A * | 10/1939 | Reggio | F04D 29/28 415/21 |
| 4,188,030 | A | 2/1980 | Hooper | |
| 4,824,102 | A | 4/1989 | Lo | |
| 4,880,225 | A | 11/1989 | Lucas et al. | |
| 4,932,649 | A | 6/1990 | Chen | |
| 4,961,569 | A | 10/1990 | Roberge | |
| 4,981,294 | A | 1/1991 | Dalebout | |
| 5,149,312 | A | 8/1992 | Croft et al. | |
| 5,290,212 | A | 3/1994 | Metcalf | |
| 5,443,434 | A | 8/1995 | Buchanan et al. | |
| 5,514,053 | A * | 5/1996 | Hawkins | A63B 21/15 482/63 |

(Continued)

*Primary Examiner* — Loan B Jimenez
*Assistant Examiner* — Shila Jalazadeh Abyaneh
(74) *Attorney, Agent, or Firm* — Kirk A. Buhler; Buhler & Associates Patenting

(57) ABSTRACT

Improvements in an exercise machine where the fan blades alter the resistance created by the blades or vanes by moving a cone that pushes the blades out from a central position. The blades or vanes push against the cone with springs. The cone is then moved into or out of the central axle to alter the effective diameter of the blades or vanes. A twist or contouring of the blades or vanes can be obtained at the same time to alter the resistance. In another embodiment, the fan blades can be individually or collectively adjusted to change the resistance. As the diameter is increased the speed of the blade tips increases as a squared function of the radius without changing the rotational speed of the vane(s). The shape, angle, scoop or tilt of the blade or vanes can also be altered to change the resistance.

8 Claims, 6 Drawing Sheets

(56) References Cited

U.S. PATENT DOCUMENTS

| | | | | |
|---|---|---|---|---|
| 5,795,270 | A | 8/1998 | Woods et al. | |
| 7,628,739 | B2 | 12/2009 | Gearon | |
| 7,955,227 | B2 | 6/2011 | Chen | |
| 8,113,996 | B1 | 2/2012 | Allen | |
| 9,415,252 | B2 | 8/2016 | Delle Donne | |
| 2007/0179025 | A1* | 8/2007 | Tsai | A63B 21/0088 482/59 |
| 2009/0156362 | A1* | 6/2009 | Berg | A63B 21/153 482/2 |

* cited by examiner

ADJUSTABLE AIR BIKE FAN BLADES

CROSS REFERENCE TO RELATED APPLICATIONS

This application claims the benefit of Provisional Application Ser. No. 62/312,395 filed Mar. 23, 2016 the entire contents of which is hereby expressly incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

This invention relates to improvements in an adjustable air bike fan blades. More particularly, the present adjustable air bike fan blades alter the diameter and/or the angle of the blades to change the amount of resistance at the same rotational speed of the fan.

Description of Related Art including information disclosed under 37 CFR 1.97 and 1.98.

Exercise equipment have some type of a resistance mechanism that increases or decreases the amount of effort to perform the exercise. The resistance mechanism takes a variety of forms from prony brake, to generators, alternators or air movement devices. Air movement devices typically consist of fan blades. For exercise bicycles a person exercising, typically pedals at a fixed rate or cadence or revolutions per minute. The cadence rate is typically between 60 and 100 turns per minute. Because the cadence rate is fairly fixed, the resistance remains the same as the person exercises. With a fan the resistance is based upon movement of air caused by the fan blades. Use of a fan provides both resistance and air movement to cool the person exercising. The use of a fan essentially does not wear-out because there are no parts rubbing against each other to cause the resistance from air movement.

A number of patents and or publications have been made that use fans to create resistance for exercise machines, and in particular bicycles. The air fan is typically mounted in-front of the person exercising and is further located between the handlebars. These exercise bicycles can include handlebars for also exercising the upper-body. Exemplary examples of patents and or publication that try to address this/these problem(s) are identified and discussed below.

One of the earliest versions of an exercise cycle using air resistance is U.S. Pat. No. 4,188,030 that issued on Feb. 12, 1980 to Lindsay A. Hooper that disclose A cycle exerciser having a vanned wheel rotatably mounted on a frame and arranged to absorb energy by movement of the broad surfaces of the vanes against the surrounding body of air. While resistance vanes are disclosed, the angle and diameter of the vanes are fixed to the rim of the cycle.

U.S. Pat. No. 4,880,225 issued on Nov. 14, 1989 to James F. Lucas et al., discloses a dual action cycle exerciser providing for exercising movement of the arms and legs using rotating pedals and oscillating handlebar levers. While the levers are linked to the pedals there is no adjustment to the blades to change the resistance.

A more modern patent is found in U.S. Pat. No. 8,113,996 that issued on Feb. 14, 2012 to Tad Allen. This patent discloses a dual action recumbent exercise cycle which provides upper body, lower body and cardiovascular conditioning with emphasis directed toward the needs of obese individuals. This patent also uses fixed fan blades.

What is needed is an adjustable air bike fan blades. The bike fan blades proposed in this document provides adjustable exercise resistance by altering the fan blade diameter and or the angle of the blades.

BRIEF SUMMARY OF THE INVENTION

It is an object of the adjustable air bike fan blades to have little or no resistance when the bike or cycle is started from a stop. For many resistance machines the resistance starts at a high level when the pedals and/or cranks are started from a resting position. For some people the initial resistance causes stress or loads on the joints, or muscles that makes them avoid exercising. With a fan type resistance, the only resistance is from the drive train and inertia on the system. Resistance from the loading mechanism is caused by the movement of air that increases as the rotating speed of the fan increases.

It is an object of the adjustable air bike fan blades for the diameter of the fan blades to be altered. The diameter of the fan blades has a relationship to the resistance. As the diameter is increased the speed of the outer tips of the blades increase as a squared function of the radius without changing the rotational speed of the blades. Changing the radius of the end of the blade from 12 to 18 inches diameter can more than double the resistance to turn the blades.

It is an object of the adjustable air bike fan blades for the blades to be individually adjustable to change the diameter of the blades and thereby the air resistance. The blades on opposing sides of the rotating hub can be adjusted or all the blades can be adjusted to alter the resistance. The blades and the adjustments mechanism is with a removable fastener or a fastener that can be loosened for adjusting the position of the blade.

It is another object of the adjustable air bike fan blades to alter the shape, angle, scoop or tilt of the blade. Changing the profile of the blade that moves the air also alters the resistance by changing the surface area i.e. the amount of work being performed by the fan. This also alters the amount of air that is available to blow on the person exercising to maintain comfortable cooling as they exercise in one location.

It is still another object of the adjustable air bike fan blades to alter the resistance created by the blades by moving a cone that pushes the blades out from a central position. The blades push against the cone with springs. The cone is then moved into or out of the central axle to alter the effective diameter of the blades. In addition to altering the blade diameter a twist or contouring of the blades can be obtained at the same time to alter the resistance.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

Figures 1, 2, 3:
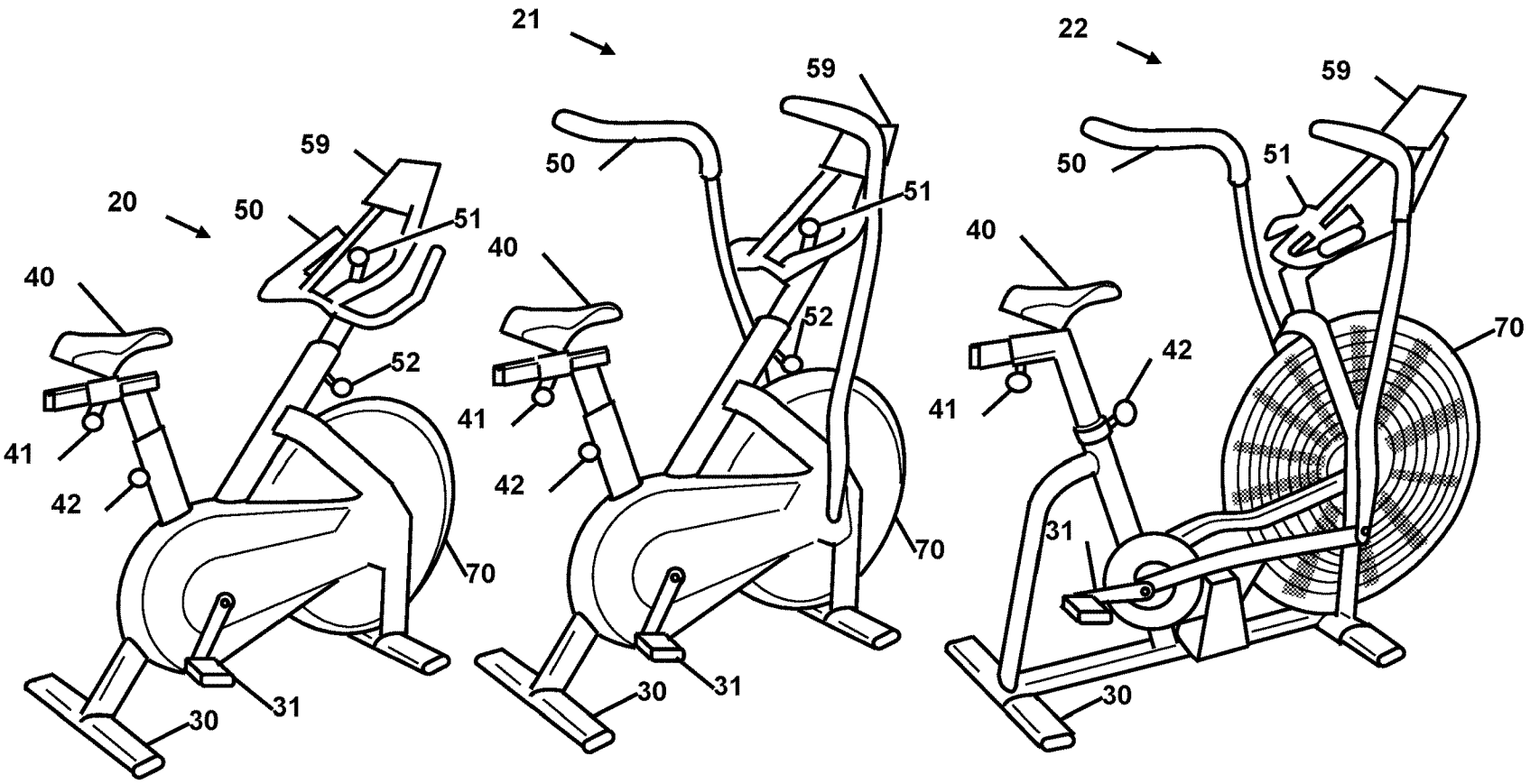
FIG. 1 shows the adjustable air bike fan blades on a spin type bike.
FIG. 2 shows the adjustable air bike fan blades on a spin type bike with elbow handlebars and swing handlebars.
FIG. 3 shows another embodiment of the adjustable air bike fan blades on a spin type bike with elbow handlebars and swing handlebars.

FIG. 1 shows the adjustable air bike fan blades on a spin type bike 20, FIG. 2 shows the adjustable air bike fan blades on a spin type bike 21 with elbow handlebars and swing handlebars and FIG. 3 shows another embodiment of the adjustable air bike fan blades on a spin type bike 22 with elbow handlebars and swing handlebars. In all these figures, the bike has a frame with legs 30 that extend from the frame. The bikes also have pedal 31 that turn a fan 70. A seat 40 has an adjustment that locks the elevation 42 and a fore aft locking pin 41 for seat adjustment relative to the handlebars 50 and the pedals 31. The handlebars 50 also have a pin 52 for adjusting the elevation of the handlebars 50 and a fore aft locking pin 51 for adjusting the position of the handlebars 50. A display 59 tracks and displays the intensity and the accumulated exercise as the bike is being used.

In FIGS. 2 and 3 a pair of handlebars 50 are placed on opposing sides of the fan 70 and display 59. The handlebars 50 are linked to the pedals 31 and the fan 70 to provide resistance for the person exercising by allowing them to exercise either the pedals 31, the handlebars 50 or a combination of both the pedals 31 and the handlebars 50 at the same time.

Figure 4:
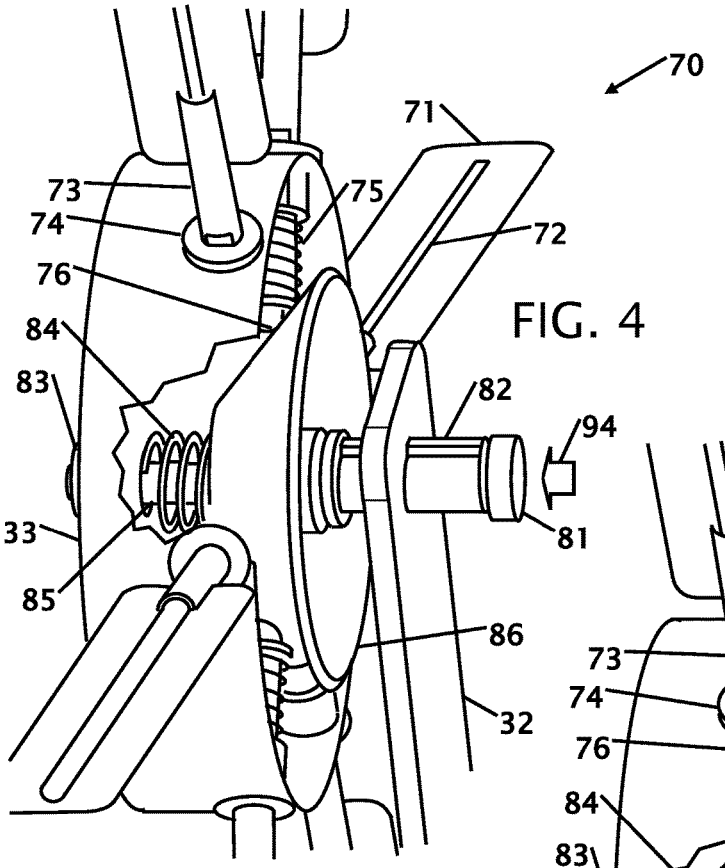
FIG. 4 shows a perspective view of the adjustable air bike fan blades with the cone withdrawn from the end of the blades.
Figure 5:
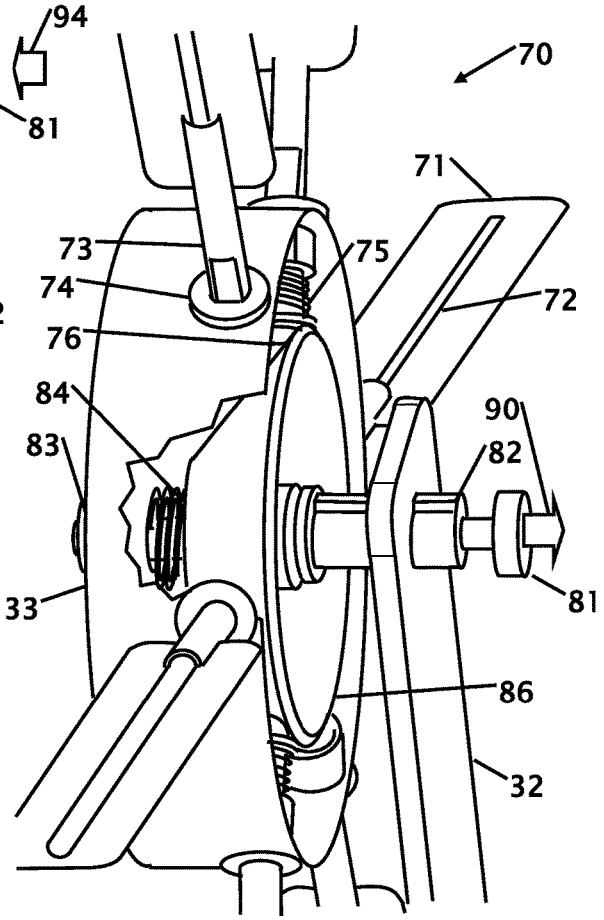
FIG. 5 shows a perspective view of the adjustable air bike fan blades with the cone pushed into the blades.

FIG. 4 shows a perspective view of the adjustable air bike fan 70 blades 71 with a cone 86 withdrawn from the end of the blades 71 and FIG. 5 shows a perspective view of the adjustable air bike fan 70 blades 71 with the cone 86 pushed into the blades 71. The cone 86 is axially supported by frame member(s) 32. A spring 84 biases the cone 86 between a housing 33 and the tapered end of the cone 86. The end of a sleeve bushing 82 is concentrically movable in as shown by arrow 94 and out as shown by arrow 90 of the housing 33 to alter the diameter of the fan blades 71.

Each fan blade 71 is supported on a support arm 72 that is connected to a shaft 73. The shaft 73 passes through a bushing 74. Where the shaft 73 passes through the bushing 74, the shaft 73 has a flat or keyed area that controls or prevents rotation of the fan blade 71. While the preferred embodiment retains the angle of the blade at a fixed angle, cupped, curved or "U" shaped cross-section configurations are contemplated. It is contemplated that the bushing 74 and the shaft 73 have a twist that turns or cups the blade 71 to alter resistance of the blade 71, as the blade 71 is moved towards and away from a rotational axle 85. Bushings or bearings 81 and 83 are located at opposing outside ends of the axle 85. The bushings 81, and 83 allow the axle to freely spin on the frame member(s) 32 that support the fan 70.

As the shaft 73 passes between the housing 33 and the cone 86, there is a spring 75 that biases an end of the shaft 73 against the cone 86. This keeps the components in tangential contact. At the end of the shaft 73 is a follower 76 that follows the cone 86 as the cone moves concentrically inside of the housing 33 on the rotational axle 85.

Figure 6:
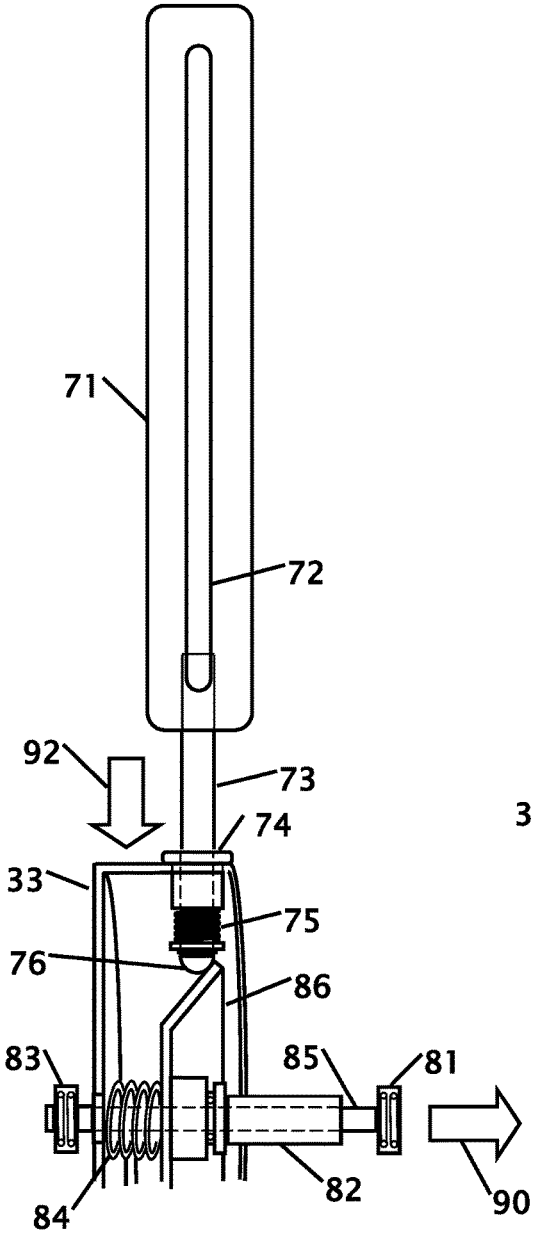
FIG. 6 shows a side sectional view of the end of the blade.

FIG. 6 shows a sectional view of the end of the blade 71. The flat area of the shaft 73 extends into the housing 33. The outer end of the blade 71 creates resistance as the flat surface of the blade 71 pushes air as the blade 71 spins around the axle 85. The flat area of the shaft 73 passes through the bushing 74 that fits though the housing 33.

The rotational axle 85 has a flat area that is placed on one or more sides to maintain a desired profile or orientation of the blade 71 as it turns in the housing 33. The follower 76 pushes against the outside surface of the cone 86. The spring 75 pushes between the bushing 74 and the follower 76.

Bearings 81 and 83 support both ends of the rotational axle 85. The sleeve bushing 82 pushes against the inside of the cone 86 to move the cone 86 concentrically within the housing 33. Spring 84 pushes the cone 86 out from the housing 33. As the cone 86 is moved out as shown by arrow 90 of the housing 33 the spring 75 pushes the shaft 73 on the blade 71 into the housing 33 as shown by arrow 92. The springs 84 and 75 maintain the components in contact. This results in a smaller outside diameter for the blades thereby requiring less effort to spin the fan blade(s) at a given rotational speed.

Figure 7:
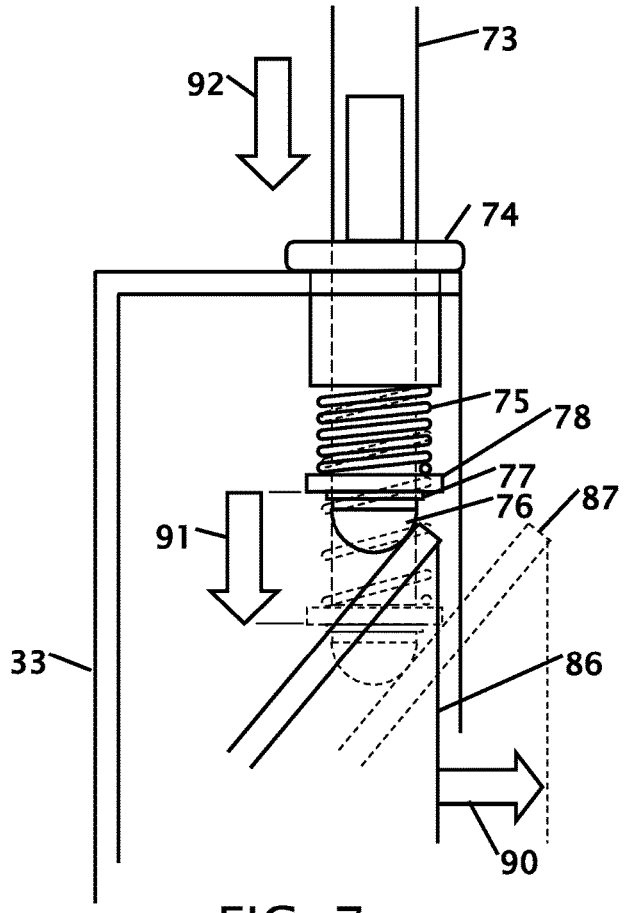
FIG. 7 shows a side sectional view of an adjustable cone.

FIG. 7 shows a side sectional view of the adjustable cone 86. The cone 86 is shown as solid lines in the inner position and as broken lines in the outermost position. The housing 33 rotates with the shaft 73 to turn the blades 71. The shaft 73 of the arm moves in a linear relationship through bushing 74. The flat or keyed area of the shaft 73 prevents undesirable rotation of the shaft 73. Spring 75 pushes between the bushing 74 and the follower 76. The spring and follower are shown as solid lines in the retracted position, and as broken lines in the extended position. A "C" clip 77 or similar locking device retains the follower on the end of the shaft 73 on an end ring 78.

The cone 86 is shown in an inner position and in an outer position 87. As the cone 86 moves out as shown by arrow 90, the spring 75 pushes the end ring 78, as shown by arrow 91 and the end of the shaft 73 into the housing 33, as shown by arrow 92. The diameter of the fan blades has a relationship to the resistance. As the diameter is increased the speed of the outer tips of the blades increase as a squared function of the radius without changing the rotational speed of the blade(s). Changing the radius of the end of the blade from 12 to 18 inches diameter can more than double the resistance to turn the blades at the same rate of rotation. It is also contemplated that the angle and/or shape of the blade can be altered to change the resistance from the fan from a first amount of resistance to a second amount of resistance at a same rate or revolution of the fan when a person in turning the pedals at a fixed rate. The adjustment may or may not be in finite steps, but detents can be incorporated to provide a visible or tactile indication of resistance to the fan spinning.

Figure 8:
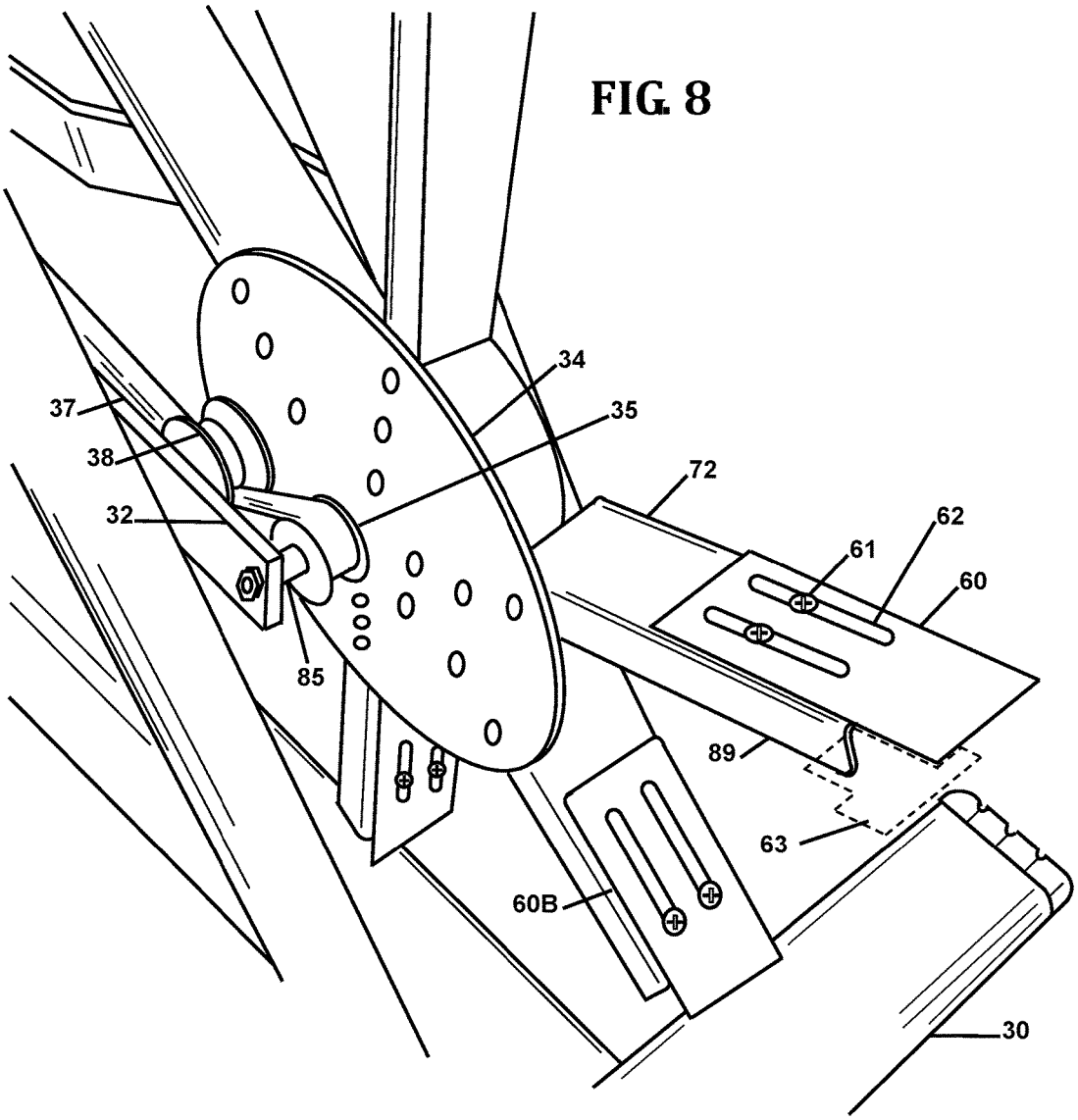
FIG. 8 is a perspective view of an alternate embodiment of an adjustable fan blade.

FIG. 8 is a perspective view of an alternate embodiment of an adjustable fan blade 60 that increases or changes air resistance. In this embodiment, the support arm 72 has a blade 60 secured to the support arm 72 with one or more fasteners 61. The supporting arms 72 also are fan blades and offer resistance when being turned. All of the blades 60 can be removed from the support arms 72 where the support arms 72 provide the air resistance. The blade 60, has one or more slots 62 that slide on the fastener 61. The fastener(s) 61 is / are loosened and the blade 60 can be slid within the constraints of the slots 62. It is contemplated that the slots 62 are not mirror image on the blade 60 to allow the blade 60 to be "flipped" to allow for a different range of adjustment. It is also contemplated that replacement blades can also be used, that are different lengths or have a turn to direct air. The support arm 72 is constructed with a reinforcing bend 89 placed on one or both sides of the support arm 72. The reinforcing bend 89 reduces flexing of the support arm 72. The support arm 72 is secured to a flywheel, rotor 34 or plate.

The flywheel, rotor 34 or plate connects multiple support arms 72 and blades 60 to the frame member 32 through the axle 85. The axle 85 has a pulley 35 that is connected to a belt 37 that is then connected to the pedals 31 or crank (shown in other figures herein). An idler 38 maintains tension on the belt 37 and increases the wrap angle on the pulley 35. The frame member 32 is secured to the remainder of the exercise bike and the supporting leg 30 member(s).

The rotating diameter of each blade 60 can be individually adjusted, and not all of the blades need to be at the same displacement on the support arm 72. This is shown in blade 60 as opposed to blade 60B. While the location of each blade 60 on the support arm 72 can be individually adjusted, blades on opposing sides to the axle 85 should be set at the same displacement to minimize rotational inertial imbalance that can cause undesirable vibration. One way to minimize variation of blade placement, is with a gauge 63. In this figure the gauge 63 has a variety of steps on different sides of the gauge 63, and the gauge 63 is placed against the support arm 72 and the displacement of the blade 60 can be consistently located.

Figure 9A:
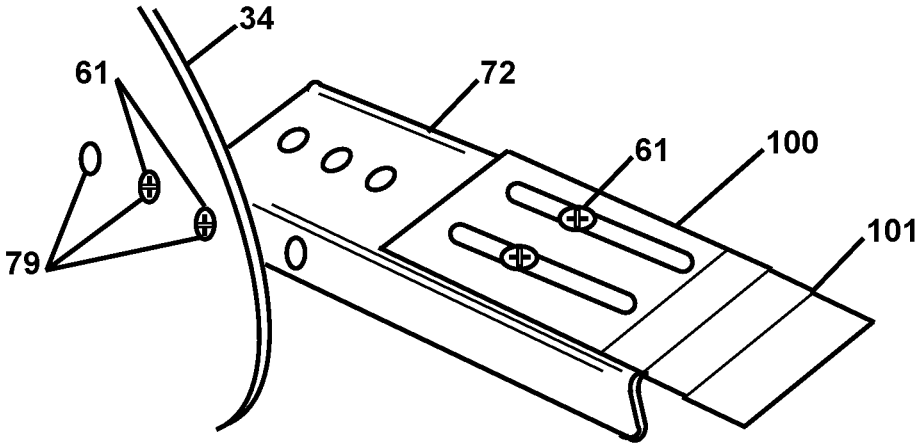
FIG. 9A shows a second alternate embodiment of an adjustable blade.

FIG. 9A shows a second alternate embodiment of an adjustable blade 100. In this embodiment, the adjustable fan blade 100 is formed with a series of finite steps or bends 101. The steps or bends 101 allow a person to adjust the extension length of the blade 100 from the support arm 72 without a gauge to set the extension length. This also allows a person to visually see that the blades 100 have been set to the same length. The fastener(s) 61 are loosened and the adjustable fan blade 100 can be slid to the desired location where the adjustable fan blade 100 is "squared" on a step or bend and then the adjustable fan blade 100 is secured by fastener(s) 61.

The position of the support arm 72 can also be adjusted on the rotor 34. Fasteners 61 can be used with holes 79 where the fasteners 61 can be removed and the supporting arm 72 can then be moved closer or further from the center of rotation.

Figure 9B:
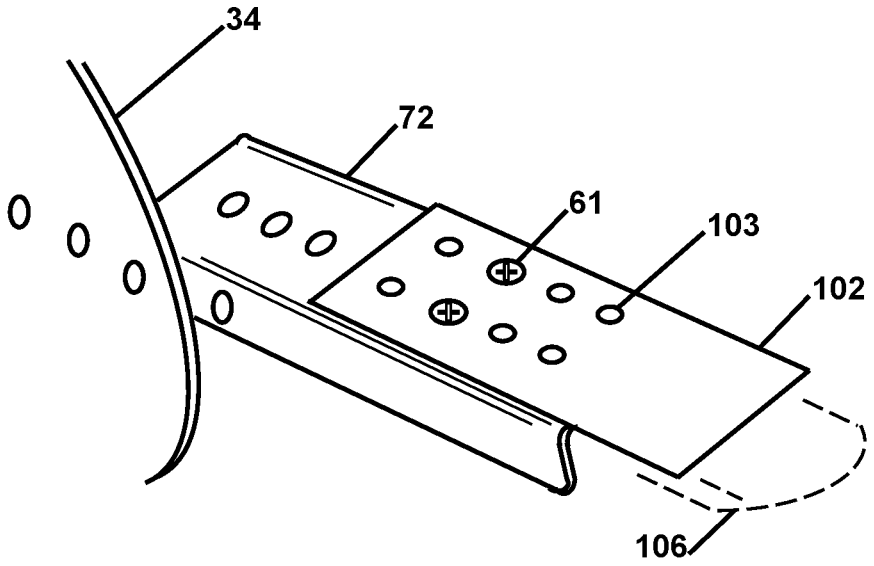
FIG. 9B shows a third embodiment of an adjustable blade.

FIG. 9B shows a third embodiment of an adjustable blade 102. In this embodiment, the adjustable blade 102 has a plurality of holes 103 that provide finite displacement for the adjustable blade 102 on the support arm 72. It is contemplated that the holes 103 are not mirror image on the adjustable blade 102 to allow the adjustable blade 102 to be "flipped" to allow for a different range of adjustment from different orientations of the adjustable blade 102. To reposition the adjustable blade 102, the fasteners 61 are removed and the adjustable blade 102 is moved to align the holes 103 of the blade with the holes in the support arm 72. The fasteners 61 are then installed and tightened. This configuration ensures a finite position that is visually verified. While the preferred embodiment retains the angle of the blade at a fixed angle, cupped, curved or "U" shaped cross-section 106 configurations are contemplated.

Figure 9C:
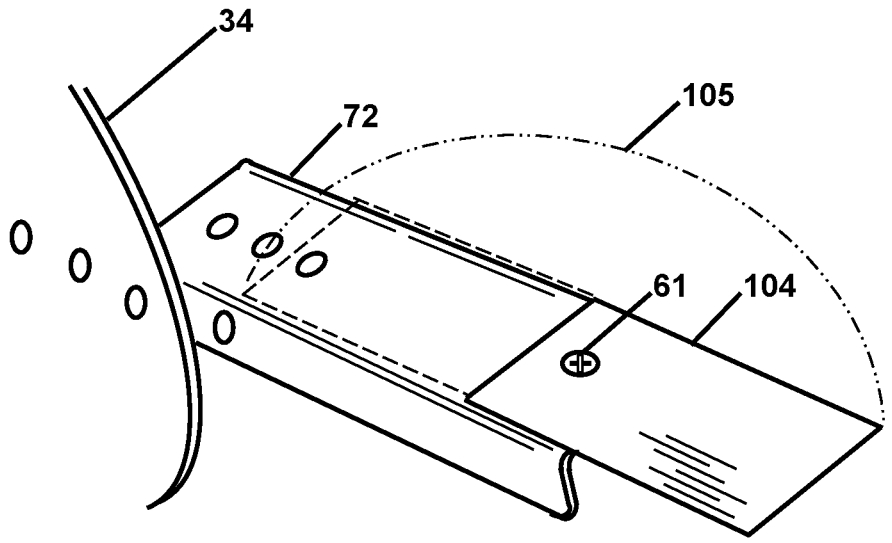
FIG. 9C shows a fourth embodiment of an adjustable blade.

FIG. 9C shows a fourth embodiment of an adjustable blade 104. In this embodiment, the blade 104 is secured to the support arm 72 with a single fastener 61. The fastener 61 is loosened and the blade 104 is rotated 105 on the support arm 72 to change the rotational diameter of the blade 104 and the resistance to rotation of the fan. The fastener 61 is a pivot for swinging the blade between positions on the supporting arm 72. The blades 104 can be adjusted on opposing sides of the hub, or all the blades 104 can be adjusted depending upon the desired amount of resistance.

Figure 9D:
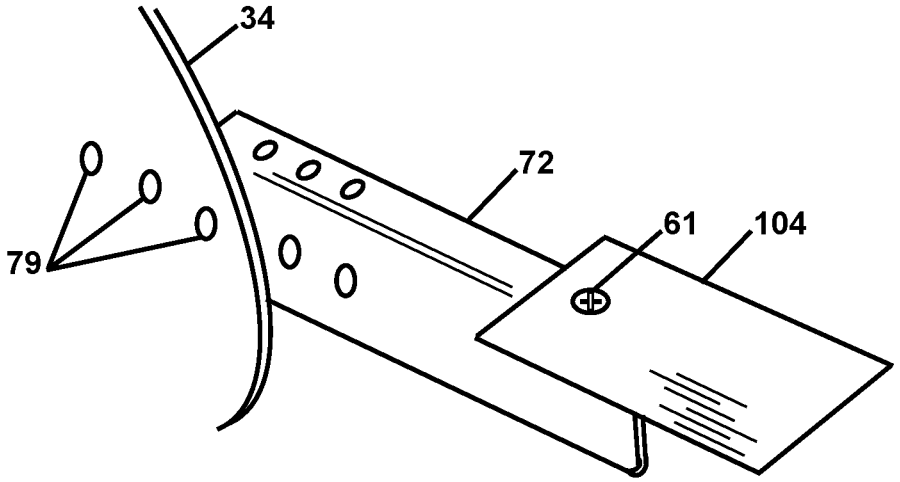
FIG. 9D shows a fifth embodiment of an adjustable blade with the arm rotated.

FIG. 9D shows a fifth embodiment of an adjustable blade with the support arm 72 rotated. Rotating the support arm 72 and or the blade 104 changes the amount of air resistance by changing the profile of the support arm 72/blade 104 that is being rotated. While the support arm shows a rotation of 90 degrees, it is contemplated that the sides of the support arm 72 can be bent at an angle other than 90 degrees to change the direction of air flow and air resistance.

Thus, specific embodiments of an adjustable air bike fan blades have been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. An adjustable mechanism for air bike fan blades comprising:

an axle;

said axle supporting a plurality of blades;

said axle further supporting a cone;

said plurality of blades in communication at a first end with said cone;

said cone being movable concentrically with said axle, whereby movement of said cone alters a rotational radius of said plurality of blades.

2. The adjustable mechanism for air bike fan blades according to claim 1, wherein a spring on each of said plurality of blades retains each of said plurality of blades in communication with said cone.

3. The adjustable mechanism for air bike fan blades according to claim 2, wherein each of said plurality of blades contacts said cone with a rounded follower.

4. The adjustable mechanism for air bike fan blades according to claim 1, wherein each of said plurality of blades is connected to a support arm that is connected to a shaft.

5. The adjustable mechanism for air bike fan blades according to claim 4, wherein said shaft has a keyed area to control rotation of said shaft passing through a cylindrical housing.

6. The adjustable mechanism for air bike fan blades according to claim 1, wherein altering said rotational radius alters a resistance caused by turning said plurality of blades at a set rotational velocity.

7. The adjustable mechanism for air bike fan blades according to claim 1, further comprising a housing that at least partially contains said cone, said housing having a plurality of bushings, whereby said plurality of blades extend or retract from said housing.

8. The adjustable mechanism for air bike fan blades according to claim 1, wherein each of said plurality of blades have a "U" shaped cross-section.

* * * * *